US011268278B2

(12) United States Patent
Sing et al.

(10) Patent No.: US 11,268,278 B2
(45) Date of Patent: Mar. 8, 2022

(54) STRUCTURAL PANEL CHASE CONNECTION MANUFACTURE METHOD

(71) Applicant: Peter Sing, McCleary, WA (US)

(72) Inventors: Peter Sing, McCleary, WA (US); Drew Sing, McCleary, WA (US)

( * ) Notice: Subject to any disclaimer, the term of this patent is extended or adjusted under 35 U.S.C. 154(b) by 0 days.

(21) Appl. No.: 16/195,230

(22) Filed: Nov. 19, 2018

(65) Prior Publication Data

US 2020/0157815 A1 May 21, 2020

(51) Int. Cl.

| | |
|---|---|
| ***E04C 2/52*** | (2006.01) |
| ***E04C 2/38*** | (2006.01) |
| ***E04B 1/61*** | (2006.01) |
| ***E04B 1/26*** | (2006.01) |
| ***E04B 1/24*** | (2006.01) |
| ***E04B 1/14*** | (2006.01) |

(52) U.S. Cl.

CPC ..... *E04C 2/521* (2013.01); *E04B 1/14* (2013.01); *E04B 1/2403* (2013.01); *E04B 1/2604* (2013.01); *E04B 1/612* (2013.01); *E04C 2/38* (2013.01); *E04B 2001/6195* (2013.01)

(58) Field of Classification Search

CPC ..... E04B 1/14; E04B 1/2043; E04B 1/2604; E04B 1/612; E04B 2001/6195; E04C 2/38; E04C 2/521

USPC ..... 52/220.1–220.3, 582.1, 585.1

See application file for complete search history.

(56) References Cited

U.S. PATENT DOCUMENTS

| | | | | |
|---|---|---|---|---|
| 2,479,870 | A * | 8/1949 | Rundquist | E06B 3/7015 428/98 |
| 2,587,804 | A * | 3/1952 | Ajne | E04B 1/26 52/578 |
| 8,881,476 | B2 * | 11/2014 | Sullivan | F24D 3/141 52/220.3 |
| 9,068,581 | B2 * | 6/2015 | Fleming, III | E04C 2/246 |
| 9,220,995 | B2 * | 12/2015 | Maxam | A63J 1/02 |
| 9,604,428 | B2 * | 3/2017 | Walker | B29D 24/002 |
| 2013/0125487 | A1 * | 5/2013 | Power | E04B 1/7076 52/302.3 |
| 2015/0096248 | A1 * | 4/2015 | Tebo | E04D 13/17 52/302.3 |
| 2017/0335567 | A1 * | 11/2017 | Chugh | E04C 2/521 |

* cited by examiner

*Primary Examiner* — William V Gilbert

(57) ABSTRACT

Structural Panel Chase Connection Manufacture Methods are the embedded frame solution to the problems associated with providing access for services, such as plumbing or electrical chases with high precision and accuracy. Connecting two or more panels in any direction using the embedded frame method becomes easy yet incredibly strong without requiring special tools for assembly or disassembly, so that components can be flat packed and stored when not in use. Flexible and variable these Structural Panel Chase Connection Manufacture Methods can accommodate a wide variety of dimensional configuration, not limited to only panel, post and beam configurations and can be manufactured using any available flat building materials.

2 Claims, 6 Drawing Sheets

High Precision Connectible Panel
Fig. 1
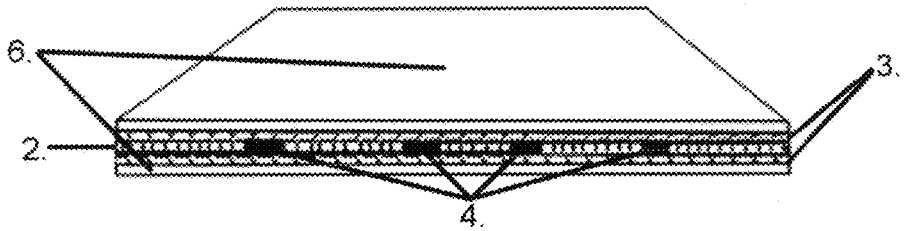
Fig. 1 A.
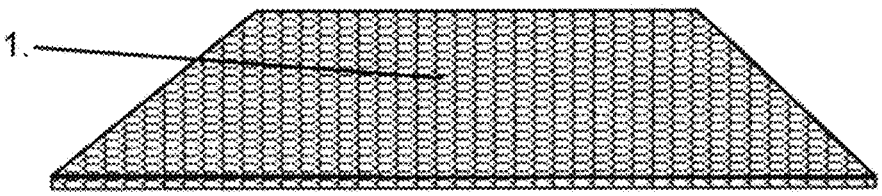
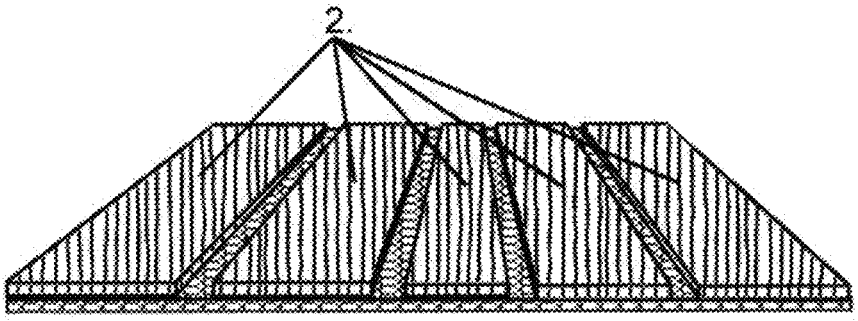
Fig. 1 B.

STRUCTURAL PANEL CHASE CONNECTION MANUFACTURE METHOD

RELATED APPLICATIONS

This application claims priority under 35 U.S.C. Section 119(C) to U.S. Provisional Application Ser. No. 62/530,709 filed Jul. 10, 2017 entitled "Structural Panel Chase Connection Manufacture Method," the disclosure of which is incorporated by reference herein in its entirety.

Embodiments of the disclosure are directed towards a structural panel which is pre-designed and manufactured to result in a composite panel yielding pre-installed chase cavities which can be used to route and host utilities and can also be used as a pre-configured method of assembling and connecting multiple panels together.

BACKGROUND

Field of the Invention

The Structural Panel Chase Connection Manufacture Method is an invention providing a solution of the manufacturing method of structural panels modified for installing chases such as cable chases or plumbing chases within any type of sandwiched building material. The same method establishes predetermined connection points which are built into the building material at the point of creation.

By using this high precision Structural Panel Chase Connection Manufacture Method, the building material does not require drilling or creating either connection points or chases for service runs following manufacture, as the access points are pre-designed and determined eliminating the need to CNC-router or modify the material following manufacture.

SUMMARY

The Structural Panel Chase Connection Manufacture Method invention includes preparing the stiles or sides of the building material prior to manufacture by creating high precision stiles or material for side to be included in any building material to be used in conjunction with other like pieces. By pre-manufacturing the sides or stiles in this high precision method, the resulting material is far more high precision than CNC routing and saves considerable time and energy in the manufacturing process.

The Structural Panel Chase Connection Manufacture Method uses existing high precision components that are easily obtainable and preserves the high precision characteristics without altering its natural state after the point of manufacture.

The Structural Panel Chase Connection Manufacture Method creates the chases, connection receptacles, or access points prior to the manufacture of the building material, so as to not being a less high precision after thought requiring alteration of the building material post-manufacture.

DETAILED DESCRIPTION

Structural Panel Chase Connection Manufacture Method

The Structural Panel Chase Connection Manufacture Method is an effective and high precision solution for embedding channels, service chases and connecting receptacles in building materials prior to manufacture. Less energy is consumed, and less waste is produced in the manufacturing process by pre-manufacturing in this manner.

Achieving higher precision is possible by pre-fabrication of chases, much more accurate than using a CNC router after the fact, without the consumption of shop time, or creation of waste material.

The Structural Panel Chase Connection Manufacture Method enables the resulting building material to be manufactured to possess embedded chase routes pre-defined by access points provided. Resulting material could remain hollow or filled with insulation or alternative composite material prior to final lamination. Completely encased service chases (i.e., for electrical or plumbing management) may be pre-installed as well (shown in drawing FIG. 2C).

The Structural Panel Chase Connection Manufacture Methods also can be used as a pre-installed connection method for connecting multiple materials (such as panels, as shown, although not limited to these dimensions). By installing a solid block as might be used in biscuit-joining, panels can easily be connected side by side or at 90-degree angles (by orienting the connecting stile sideways).

Structural Panel Chase Connection Manufacture Method makes possible a tension connection method whereby the connecting block is pre-drilled with a hole for which to run a tension cable or rod through multiple panels and secured at the ends. This provides incredible structure strength yet need not be a permanent assembly as the tension can be released and the multiple panels can easily be separated. This is particularly advantageous when used as a temporary wall.

Components

Preconfigured Channel Base

Preconfigured channel base material is created by laminating flat building material horizontally side by side separated by pre-measured spaced between to vertically oriented flat building materials. Exterior flat building materials can be either made of like materials or different materials, as specifications may vary based on the intended use of the resulting materials.

Following lamination, the resulting composite base material with the preconfigured channels are cut into strips perpendicular to the channels at pre-defined widths, to effectively create a 3-D frame material to be used in the next stage.

Access Point Framing

The composite preconfigured channel base is used as framing material for the manufacture of a resulting building material. The example shown depicts the use of this method in a configuration appropriate in the creation of panels but is not limited to this function or these dimensions. In the example channeled frame material is used as an interior frame to be sandwiched between two pieces of flat building material, such as plywood, or metal.

Prior to adding the exterior surface materials, enclosed chases may be installed, insulation or other composite materials may be inserted, or the inside expanses may be left empty prior to lamination.

The resulting panels will have perfect, high precision access points which can be used as service chases run through the resulting panel, or pre-defined connection points.

Joining Blocks

Structural Panel Chase Connection Manufacture Method may be connected one to another by the use of joining blocks. Joining blocks are measured to precisely fill the connection point voids, with one half of the block going into each panel void. In a permanent installation, joining block could be adhered using glue or other adhesive. In temporary installations, connection method could include adding a set screw, or other anchoring device. Alternate tension block connection method (shown in FIG. 3B) includes a hold drilled through the center of the joining block to accommodate the use of a cable or rod to string successive panels in a row and can be tightened and secured to create an extremely effective and strong connection, such as a temporary retaining wall, etc.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIGS. 1A-1C illustrate exemplary embodiments for a lamination of materials together to create the structural panel with chase voids (FIG. 1 C.4) in accordance with the present enclosure;

DETAILED DESCRIPTION OF THE PREFERRED EMBODIMENTS

Related art consists of four sets of drawings.

Figure 1C:
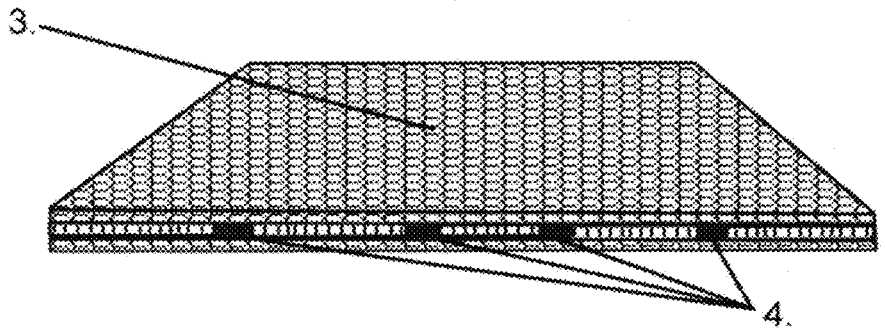

FIGS. 1A-1C illustrate exemplary embodiments for a lamination of materials together to create the structural panel with chase voids (FIG. 1) in accordance with the present enclosure. FIG. 1A depicts the flat base material (1) on which the (FIG. 1B) sub material (2) is placed with channel spaces between. FIG. 1C demonstrates the top layer of flat material (3) which is applied prior to press lamination of all components. The interior material is oriented perpendicular to create high precision channels (4) in the base material (which will be sliced into framing material).

Figure 2A:
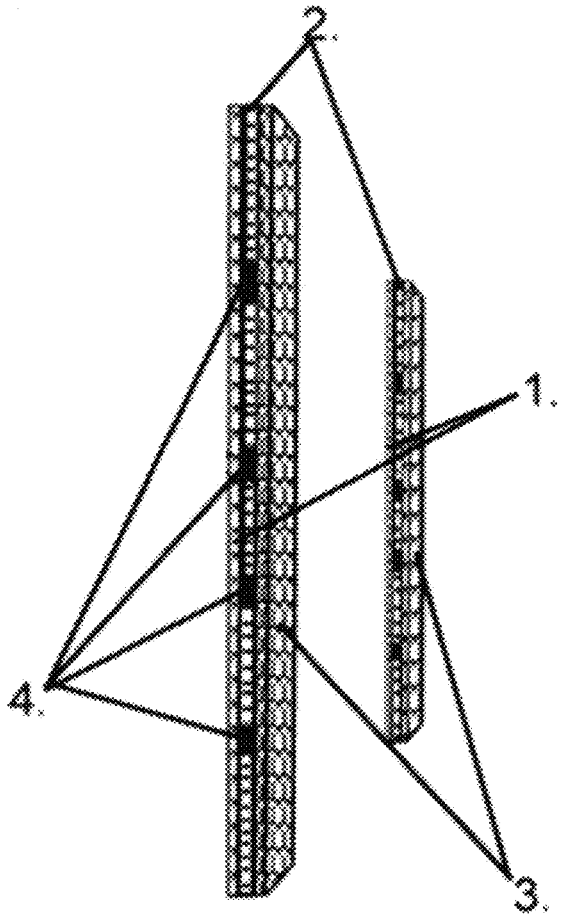
FIGS. 2A-2D illustrate additional embodiments for cutting panels into strips (FIG. 2 A) and using as framing material inside empty of filled (filled not shown) panel configuration in accordance with the present enclosure.
Figure 2B:
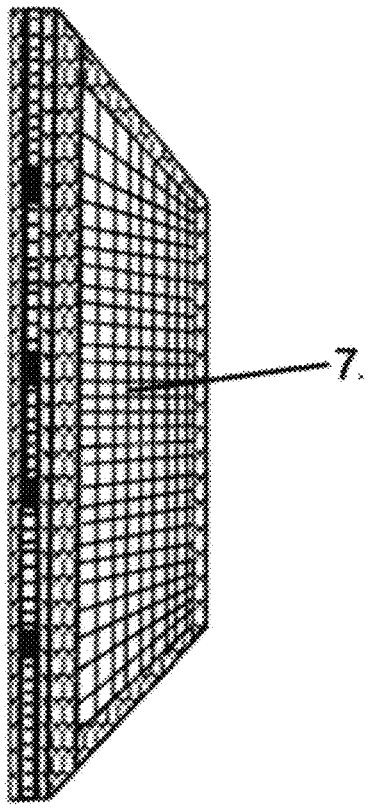
Figure 2C:
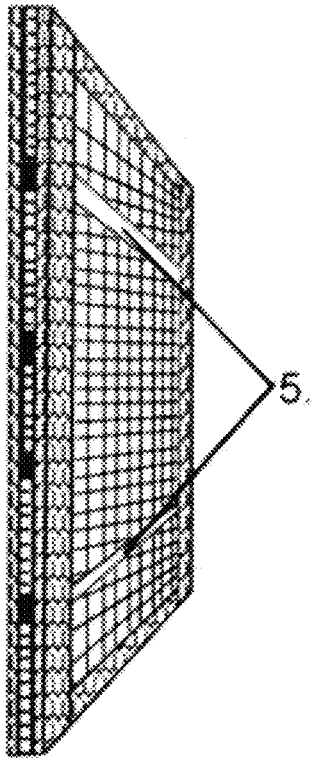
Figure 2D:
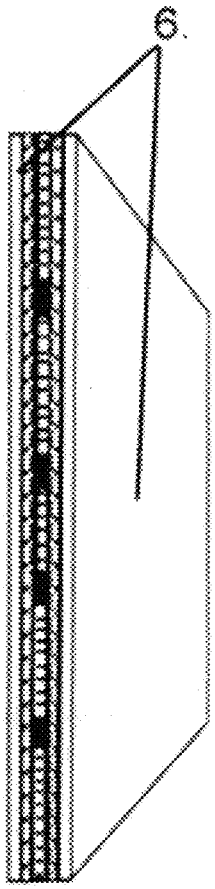

FIGS. 2A-2D illustrate additional embodiments for cutting panels into strips and using as framing material inside empty or filled panel configuration in accordance with the present enclosure. This set of drawings depict the use of the strips cut from full panel (FIG. 1C) to create frame material with high precision channels to create an interior frame in a flat panel configuration. FIG. 2A represents two stiles left and right of a frame. FIG. 2B shows completed stile and rail frame. FIG. 2C shows how service chases (5) can be installed and FIG. 2D shows how exterior surface material (6) can be laminated to the result (filled or voids inside panel).

Figure 3A:
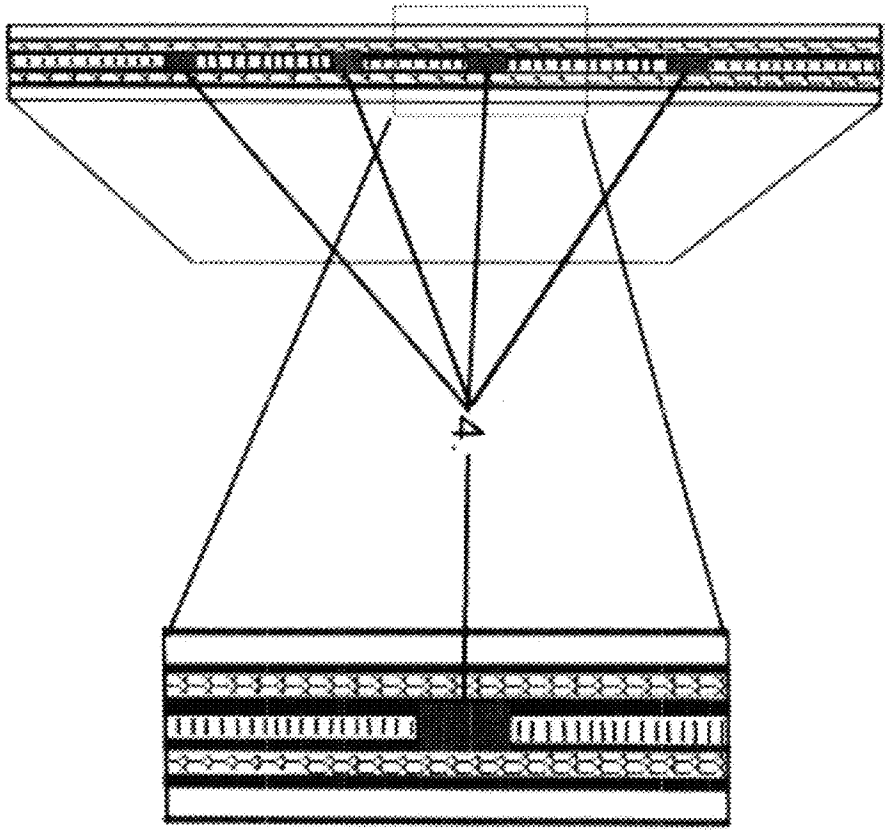
FIG. 3A-3C illustrate details of connection point (FIG. 3 A.4) without and with connection block (FIG. 3 B) insert with zoomed-in cutaway view.
Figure 3:
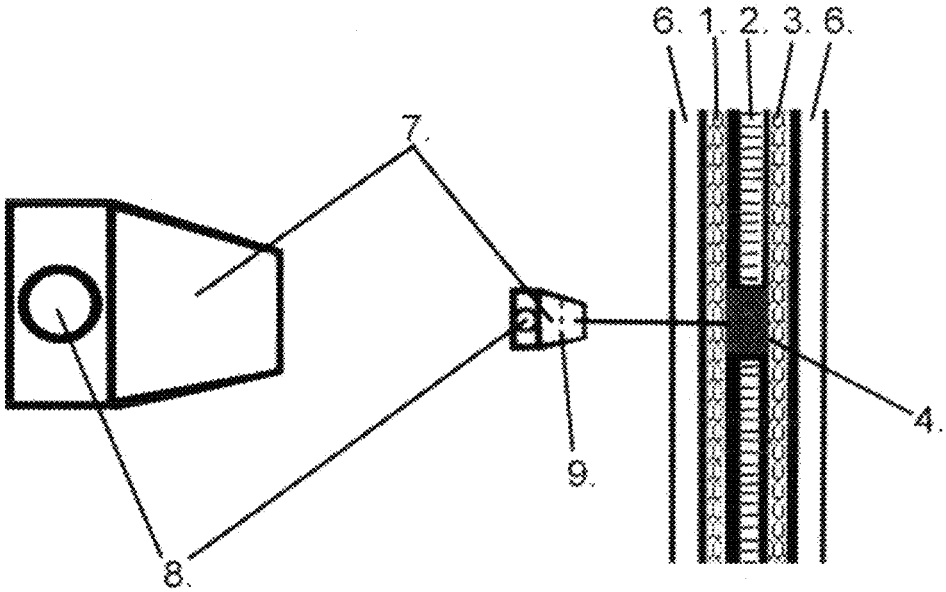

FIG. 3A-3C illustrate details of connection point without and with block insert. Set of drawings show the high precision receptacles used as connection points, joining multiple panels in a side by side configuration using connecting blocks. FIG. 3A zooms-in on the detail of the high precision connection point seen as a rectangular hole left open (4). FIG. 3B details the connection block (7) shown which fills the open rectangle hole and this version is pre-drilled with a tension connection hole (8) for running a rod or cable through which can be tightened and secured for extra strength in temporary conditions. Tension can be released for rapid disassembly. Block shown in FIG. 3C is set up for straight in-line assembly of successively joined panels. The dotted line midway of the block (9) indicates that one-half of the block would be inside the vacant opening (4) and the other half, otherwise exposed, would be inserted into the adjoining panel vacancy for connecting the two panels together. FIG. 3C also depicts the laminated materials used to create a full finished panel. From left to right would be the surface material (6), the base material (1), with the sub material (2) in the middle, followed by closing base material (3) and another surface material (6). Other blocks can come in different shapes and sizes to accommodate connecting and securing at any angle, for example L-shaped blocks for 45-degree angles.

The invention claimed is:

1. A method of assembling a laminate panel, comprising:

preparing a side material, said side material comprising a first flat base sheet, a second flat base sheet and a plurality of strips between said first flat base sheet and said second flat base sheet, said strips extending from a first side of said first and said second sheet to a second side opposite said first side of said first and said second sheet, and a channel being between adjacent ones of said strips, each said channel extending from said first side of said first sheet and said second sheet to said second side of said first sheet and said second sheet;

cutting said side material into a first stile and a second stile; placing said first stile and said second stile in a spaced relationship, each said stile having a first end portion and a second end portion;

placing a first rail and a second rail, each said rail having a first surface and a second surface opposite said first surface, said first rail being between said first end portions of said first stile and said second stile and said second rail being between said second end portions of said first stile and said second stile; said first stile, said second stile said first rail and said second rail forming a perimeter of said panel and defining a space;

placing a first additional member in said space, said first additional member extending from said first stile to said second stile, and placing a second additional member in said space, said second additional member extending from first stile to said second stile, placing a first surface material over said first surfaces of said first stile, said second stile, said first rail and said second rail, placing a second surface material over said second surfaces of said first stile, said second stile, said first rail and said second rail to form said panel.

2. The method of claim 1, further comprising:

placing a connection block having a hole drilled therein into one of said channels, said connection block configured for use in connection of adjacent panels.

* * * * *